US011363403B2

(12) United States Patent
Laaksonen

(10) Patent No.: US 11,363,403 B2
(45) Date of Patent: Jun. 14, 2022

(54) SPATIAL AUDIO AUGMENTATION AND REPRODUCTION

(71) Applicant: Nokia Technologies Oy, Espoo (FI)

(72) Inventor: Lasse Laaksonen, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 17/282,423

(22) PCT Filed: Oct. 1, 2019

(86) PCT No.: PCT/FI2019/050700
§ 371 (c)(1),
(2) Date: Apr. 2, 2021

(87) PCT Pub. No.: WO2020/074770
PCT Pub. Date: Apr. 16, 2020

(65) Prior Publication Data

US 2021/0385607 A1 Dec. 9, 2021

(30) Foreign Application Priority Data

Oct. 8, 2018 (GB) ..... 1816389

(51) Int. Cl.
*H04S 7/00* (2006.01)
*H04S 3/00* (2006.01)

(52) U.S. Cl.
CPC ..... *H04S 7/304* (2013.01); *H04S 3/004* (2013.01); *H04S 2400/11* (2013.01); *H04S 2420/03* (2013.01)

(58) Field of Classification Search
CPC ..... H04S 7/304; H04S 2400/11; H04S 3/004; H04S 2420/03
USPC ..... 381/310
See application file for complete search history.

(56) References Cited

U.S. PATENT DOCUMENTS

2009/0116652 A1 5/2009 Kirkeby et al. ..... 381/1
2010/0217585 A1 8/2010 Karlsson et al. ..... 704/219

FOREIGN PATENT DOCUMENTS

CN 105190747 A 12/2015
CN 105593930 A 5/2016
CN 106816156 A 6/2017
CN 108141692 A 6/2018
EP 2 146 522 A1 1/2010

OTHER PUBLICATIONS

Jarvinen, K. et al. "Refinements for MPEG-I Phase Draft Audio Requirements." International Organization for Standardization. ISO/IEC JTC1/SC27/WG11 MPEG2018/M44827; Oct. 2018. (Year: 2018).*

(Continued)

*Primary Examiner* — Paul Kim
(74) *Attorney, Agent, or Firm* — Harrington & Smith

(57) ABSTRACT

An apparatus including circuitry configured for: obtaining at least one spatial audio signal including at least one audio signal, wherein the at least one spatial audio signal defines an audio scene forming at least in part media content; rendering an audio scene based on the at least one spatial audio signal; obtaining at least one augmentation audio signal; transforming the at least one augmentation audio signal to at least two audio objects; augmenting the audio scene based on the at least two audio objects.

20 Claims, 13 Drawing Sheets

(56) References Cited

OTHER PUBLICATIONS

Jarvinen, K. et al. Refinements for MPEG-I Phase Draft Audio Requirements. International Organisation for Standardisation. ISO/IEC JTC1/SC29/WG11 MPEG2018/M44827; Oct. 3, 2018.
Draft MPEG-I Audio Requirements. International Organisation for Standardisation. ISO/IEC JTC1/SC29/WG11 MPEG2015/N17848; Jul. 20, 2018.
Nikunen, J. Object-based Modeling of Audio for Coding and Source Separation, Doctoral Thesis, Tampere University of Technology, Jan. 2015, ISSN 1459-2045, ISBN 978-952-15-3452-2. I.
MPEG-I Audio Architectures. International Organisation for Standardisation. ISO/IEC JTC1/SC29/WG11 N17847; Jul. 20, 2018.
Spatial Audio Workstation User Manual. Barco Audio Technologies, [online], Jul. 31, 2017, [retrieved on Oct. 30, 2019], Retrieved from http://www.losono-sound.com/uploads/downloads/SAW_User_Maual_24.pdf pp. 28-30, Figure 39.
Marston, D., "The Audio Definition Model", Position paper for the 4$^{th}$ W3C Web and TV Workshop, Mar. 2014, 3 pgs.

* cited by examiner 903
905
801

951
rotate
913
915
801 bring closer
953
801
923
925
931

SPATIAL AUDIO AUGMENTATION AND REPRODUCTION

CROSS REFERENCE TO RELATED APPLICATION

This patent application is a U.S. National Stage application of International Patent Application Number PCT/FI2019/050700 filed Oct. 1, 2019, which is hereby incorporated by reference in its entirety, and claims priority to GB 1816389.9 filed Oct. 8, 2018.

FIELD

The present application relates to apparatus and methods for spatial sound augmentation and reproduction, but not exclusively for spatial sound augmentation and reproduction within an audio encoder and decoder.

BACKGROUND

Immersive audio codecs are being implemented supporting a multitude of operating points ranging from a low bit rate operation to transparency. An example of such a codec is the immersive voice and audio services (IVAS) codec which is being designed to be suitable for use over a communications network such as a 3GPP 4G/5G network including use in such immersive services as for example immersive voice and audio for virtual reality (VR). This audio codec is expected to handle the encoding, decoding and rendering of speech, music and generic audio. It is furthermore expected to support channel-based audio and scene-based audio inputs including spatial information about the sound field and sound sources. The codec is also expected to operate with low latency to enable conversational services as well as support high error robustness under various transmission conditions.

Furthermore parametric spatial audio processing is a field of audio signal processing where the spatial aspect of the sound (or sound scene) is described using a set of parameters. For example, in parametric spatial audio capture from microphone arrays, it is a typical and an effective choice to estimate from the microphone array signals a set of parameters such as directions of the sound in frequency bands, and the ratios between the directional and non-directional parts of the captured sound in frequency bands. These parameters are known to well describe the perceptual spatial properties of the captured sound at the position of the microphone array. These parameters can be utilized in synthesis of the spatial sound accordingly, for headphones binaurally, for loudspeakers, or to other formats, such as Ambisonics.

Immersive media technologies are currently being standardised by MPEG under the name MPEG-I. These technologies include methods for various virtual reality (VR), augmented reality (AR) or mixed reality (MR) use cases. MPEG-I is divided into three phases: Phases 1a, 1b, and 2. The phases are characterized by how the so-called degrees of freedom in 3D space are considered. Phases 1a and 1b consider 3DoF and 3DoF+ use cases, and Phase 2 will then allow at least significantly unrestricted 6DoF.

An example of an augmented reality (AR)/virtual reality (VR)/mixed reality (MR) application is an audio (or audio-visual) environment immersion where 6 degrees of freedom (6DoF) content rendering is implemented.

However additional 6DoF technology is needed on top conventional immersive codecs such as MPEG-H 3D Audio.

SUMMARY

There is provided according to a first aspect an apparatus comprising means for: obtaining at least one spatial audio signal comprising at least one audio signal, wherein the at least one spatial audio signal defines an audio scene forming at least in part media content; rendering an audio scene based on the at least one spatial audio signal; obtaining at least one augmentation audio signal; transforming the at least one augmentation audio signal to at least two audio objects; augmenting the audio scene based on the at least two audio objects.

The means for transforming the at least one augmentation audio signal to at least two audio objects may be further for generating at least one control criteria associated with the at least two audio objects, wherein the means for augmenting the audio scene based on the at least two audio objects may be further for augmenting the audio scene based on the at least one control criteria associated with the at least two audio objects.

The means for augmenting the audio scene based on the at least one control criteria associated with the at least two audio objects may be further for at least one of: defining a largest distance allowed between the at least two audio objects; defining a largest distance allowed between at least two audio objects relative to a distance to a user; defining a rotation relative to a user; defining a rotation of an audio object constellation; defining whether a user is permitted to be located between the at least two audio objects; and defining an audio object constellation configuration.

The means may be further for obtaining at least one augmentation control parameter associated with the at least one audio signal, wherein the means for augmenting the audio scene based on the at least two audio objects may be further for augmenting the audio scene based on the at least two audio objects and the at least one augmentation control parameter.

The means for obtaining at least one spatial audio signal comprising at least one audio signal may be for decoding from a first bit stream the at least one spatial audio signal and the at least one spatial parameter.

The first bit stream may be a MPEG-I audio bit stream.

The means for obtaining at least one augmentation control parameter associated with the at least one audio signal may be further for decoding from the first bit stream the at least one augmentation control parameter associated with the at least one audio signal.

The means for obtaining at least one augmentation audio signal may be further for decoding from a second bit stream the at least one augmentation audio signal.

The second bit stream may be a low-delay path bit stream.

The means for obtaining at least one augmentation audio signal may be for obtaining at least one of: at least one user voice audio signal; at least one ambience part captured at a user position; at least two audio objects selected from a set of audio objects to augment the at least one spatial audio signal.

According to a second aspect there is provided a method comprising: obtaining at least one spatial audio signal comprising at least one audio signal, wherein the at least one spatial audio signal defines an audio scene forming at least in part media content; rendering an audio scene based on the at least one spatial audio signal; obtaining at least one augmentation audio signal; transforming the at least one augmentation audio signal to at least two audio objects; augmenting the audio scene based on the at least two audio objects.

Transforming the at least one augmentation audio signal to at least two audio objects may further comprise generating at least one control criteria associated with the at least two audio objects, wherein augmenting the audio scene based on the at least two audio objects may further comprise augmenting the audio scene based on the at least one control criteria associated with the at least two audio objects.

Augmenting the audio scene based on the at least one control criteria associated with the at least two audio objects may further comprise at least one of: defining a largest distance allowed between the at least two audio objects; defining a largest distance allowed between at least two audio objects relative to a distance to a user; defining a rotation relative to a user; defining a rotation of an audio object constellation; defining whether a user is permitted to be located between the at least two audio objects; and defining an audio object constellation configuration.

The method may further comprise obtaining at least one augmentation control parameter associated with the at least one audio signal, wherein augmenting the audio scene based on the at least two audio objects may further comprise augmenting the audio scene based on the at least two audio objects and the at least one augmentation control parameter.

Obtaining at least one spatial audio signal comprising at least one audio signal may further comprise decoding from a first bit stream the at least one spatial audio signal and the at least one spatial parameter.

The first bit stream may be a MPEG-I audio bit stream.

Obtaining at least one augmentation control parameter associated with the at least one audio signal may further comprise decoding from the first bit stream the at least one augmentation control parameter associated with the at least one audio signal.

Obtaining at least one augmentation audio signal may further comprise decoding from a second bit stream the at least one augmentation audio signal.

The second bit stream may be a low-delay path bit stream.

Obtaining at least one augmentation audio signal may further comprise obtaining at least one of: at least one user voice audio signal; at least one ambience part captured at a user position; at least two audio objects selected from a set of audio objects to augment the at least one spatial audio signal.

According to a third aspect there is provided an apparatus comprising at least one processor and at least one memory including a computer program code, the at least one memory and the computer program code configured to, with the at least one processor, cause the apparatus at least to: obtain at least one spatial audio signal comprising at least one audio signal, wherein the at least one spatial audio signal defines an audio scene forming at least in part media content; render an audio scene based on the at least one spatial audio signal; obtain at least one augmentation audio signal; transform the at least one augmentation audio signal to at least two audio objects; and augment the audio scene based on the at least two audio objects.

The apparatus caused to transform the at least one augmentation audio signal to at least two audio objects may further be caused to generate at least one control criteria associated with the at least two audio objects, wherein the apparatus caused to augment the audio scene based on the at least two audio objects may further be caused to augment the audio scene based on the at least one control criteria associated with the at least two audio objects.

The apparatus caused to augment the audio scene based on the at least one control criteria associated with the at least two audio objects may further be caused to perform at least one of: define a largest distance allowed between the at least two audio objects; define a largest distance allowed between at least two audio objects relative to a distance to a user; define a rotation relative to a user; define whether a user is permitted to be located between the at least two audio objects; and define an audio object constellation configuration.

The apparatus may be further caused to obtain at least one augmentation control parameter associated with the at least one audio signal, wherein the apparatus caused to augment the audio scene based on the at least two audio objects may further be caused to augment the audio scene based on the at least two audio objects and the at least one augmentation control parameter.

The apparatus caused to obtain at least one spatial audio signal comprising at least one audio signal may further be caused to decode from a first bit stream the at least one spatial audio signal and the at least one spatial parameter.

The first bit stream may be a MPEG-I audio bit stream.

The apparatus caused to obtain at least one augmentation control parameter associated with the at least one audio signal may further be caused to decode from the first bit stream the at least one augmentation control parameter associated with the at least one audio signal.

The apparatus caused to obtain at least one augmentation audio signal may further be caused to decode from a second bit stream the at least one augmentation audio signal.

The second bit stream may be a low-delay path bit stream.

The apparatus caused to obtain at least one augmentation audio signal may further be caused to obtain at least one of: at least one user voice audio signal; at least one ambience part captured at a user position; at least two audio objects selected from a set of audio objects to augment the at least one spatial audio signal.

According to a fourth aspect there is provided a computer program comprising instructions [or a computer readable medium comprising program instructions] for causing an apparatus to perform at least the following: obtaining at least one spatial audio signal comprising at least one audio signal, wherein the at least one spatial audio signal defines an audio scene forming at least in part media content; rendering an audio scene based on the at least one spatial audio signal; obtaining at least one augmentation audio signal; transforming the at least one augmentation audio signal to at least two audio objects; augmenting the audio scene based on the at least two audio objects.

According to a fifth aspect there is provided a non-transitory computer readable medium comprising program instructions for causing an apparatus to perform at least the following: obtaining at least one spatial audio signal comprising at least one audio signal, wherein the at least one spatial audio signal defines an audio scene forming at least in part media content; rendering an audio scene based on the at least one spatial audio signal; obtaining at least one augmentation audio signal; transforming the at least one augmentation audio signal to at least two audio objects; augmenting the audio scene based on the at least two audio objects.

According to a sixth aspect there is provided an apparatus comprising: obtaining circuitry configured to obtain at least one spatial audio signal comprising at least one audio signal, wherein the at least one spatial audio signal defines an audio scene forming at least in part media content; rendering circuitry configured to render an audio scene based on the at least one spatial audio signal; the obtaining circuitry further configured to obtain at least one augmentation audio signal; transforming circuitry configured to transform the at least one augmentation audio signal to at least two audio objects; augmenting circuitry configured to augment the audio scene based on the at least two audio objects. According to a seventh aspect there is provided a computer readable medium comprising program instructions for causing an apparatus to perform the method as described above.

An apparatus comprising means for performing the actions of the method as described above.

An apparatus configured to perform the actions of the method as described above.

A computer program comprising program instructions for causing a computer to perform the method as described above.

A computer program product stored on a medium may cause an apparatus to perform the method as described herein.

An electronic device may comprise apparatus as described herein.

A chipset may comprise apparatus as described herein.

Embodiments of the present application aim to address problems associated with the state of the art.

SUMMARY OF THE FIGURES

For a better understanding of the present application, reference will now be made by way of example to the accompanying drawings in which.

EMBODIMENTS OF THE APPLICATION

Figure 1:
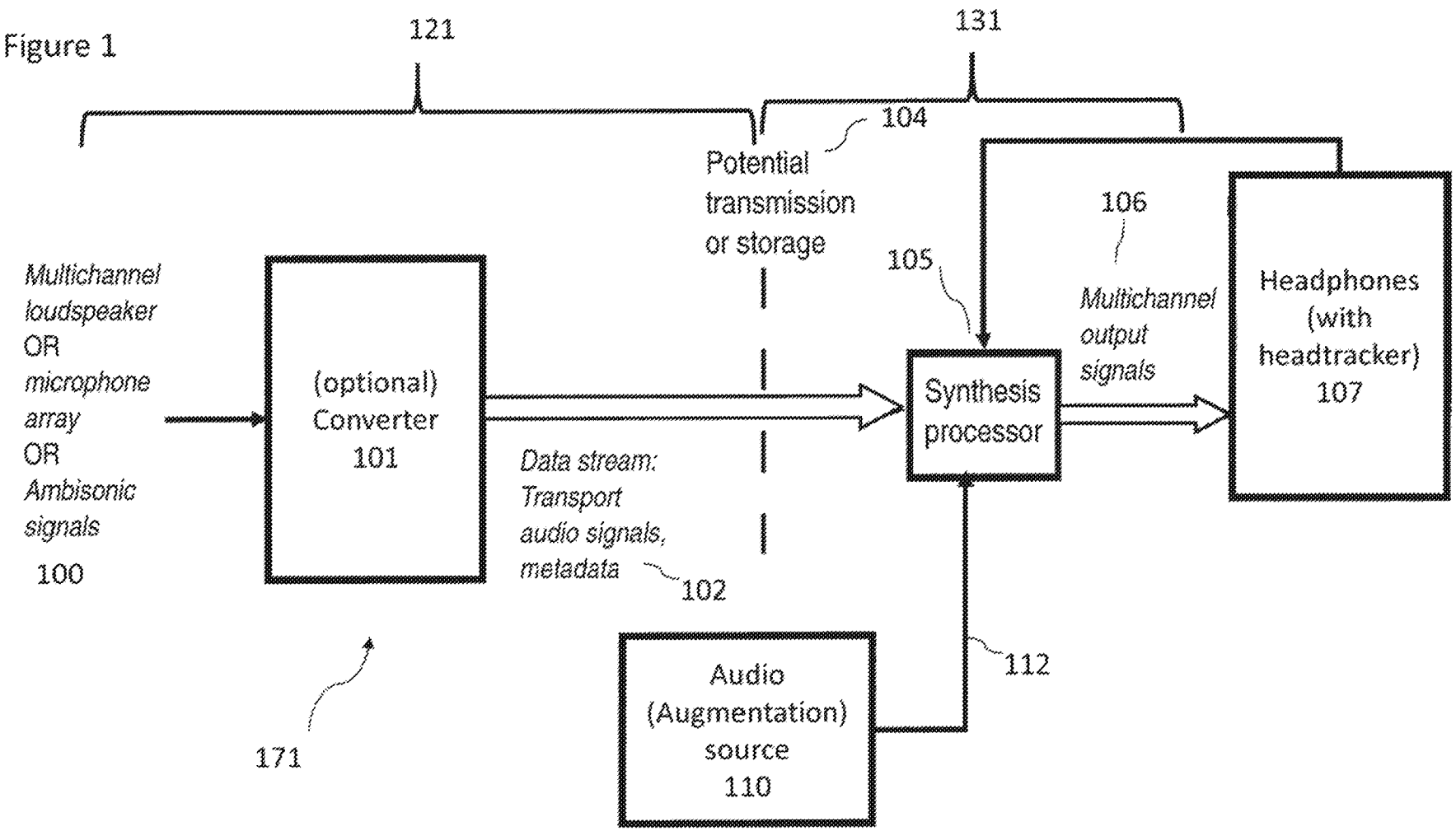
FIG. 1 shows schematically a system of apparatus suitable for implementing some embodiments.

The following describes in further detail suitable apparatus and possible mechanisms for the provision of effective control of spatial augmentation settings and signalling of immersive media content.

According to current proposed architectures, MPEG-I 6DoF audio renderers are able to decode and render encoded MPEG-H 3D audio core encoded signals. The renderer is also able to render in the 6DoF scene low-delay path communications audio signals that has been decoded outside the MPEG-I system, for example by using an external decoder and which are provided to the renderer in a suitable format (for example one corresponding to MPEG-H 3D Audio capabilities).

The current proposed architectures do not provide capability for decoding or rendering of parametric immersive audio, which has been shown to be the best available format for multi-microphone capture on practical mobile devices implementing irregular microphone array configurations. Such audio inputs would be useful for immersive audio augmentation in many use cases.

Where an immersive input is not supported by the renderer in a native format, the low-delay path audio needs to be transformed into a format compatible with the 6DoF renderer. This transformation typically results in a quality loss, and it may also compromise the low-delay' aspect. Therefore an external renderer can be used to render this additional media, which can, e.g., be mixed with the rendered 6DoF content.

Combining at least two immersive media streams, such as immersive MPEG-I 6DoF audio content and a 3GPP EVS audio with additional spatial location metadata or a 3GPP IVAS spatial audio, in a spatially meaningful way is made possible when a common interface is implemented for the renderer. Using a common interface may for example allow a 6DoF audio content be augmented by a further audio stream. The augmenting content may be rendered at a certain position or positions in the 6DoF scene/environment.

The embodiments as discussed with further detail herein attempt to provide a 3DoF immersive low-delay audio stream to a 6DoF renderer with smallest loss of perceptual quality even when the native format is not supported.

Furthermore the embodiments attempt to maintain dependencies relating to the 3DoF sound scene or sound source(s) in the augmented 6DoF rendering following an audio format transformation into a non-native format. As such the embodiments attempt to allow as much freedom in the 6DoF placement of the transformed 3DoF augmentation audio as the 6DoF native audio format allows in order to get full advantage of the 6DoF renderer capabilities and functionalities (such as but not limited to user interface (UI) controls that may allow, e.g., displacing audio objects in the scene).

As such the concept as discussed herein relates to a signalling of a spatial dependency between at least two immersive audio components that are formed after decoding via an audio format transformation (or by a direct decoding) into a non-native audio format. The signalling can be used at least to maintain a correct sound image of (at least a part of) a 3DoF audio scene that is augmented onto a 6DoF media content. In some embodiments the spatial dependency may be part of the input signals to the encoder (based on analysis or, for example provided by a content creation tool input). In some other embodiments the spatial dependency may be derived as part of the encoding. In some further embodiments the spatial dependency may be derived as part of the decoding. Additionally in some embodiments the spatial dependency may be derived as part of the format transformation.

In some embodiments such as the first two cases described above require this information to be separately transmitted in some embodiments.

In some embodiments a signalling of a spatial dependency metadata as part of a 3DoF or 6DoF metadata is performed. This may be useful, for example, if user A is consuming a first 6DoF content and user B is consuming a second 3DoF or 6DoF content, and user B wishes to communicate (using immersive audio) with user A. User B's communication may include, for example, audio objects from his content scene, which may have a spatial dependency that needs to be transmitted to user A for proper rendering.

The embodiments as discussed herein thus follow a transformation of a parametric (or any other) immersive audio content into at least two audio objects (with optional other components such as at least one first order ambisonic (FOA) stream, e.g., for carrying at least one ambience part). The object-based representation provides the freedom for a 6DoF placement of, e.g., separated sound sources. However, this freedom may also break the sound image if any important dependency is lost in the transformation.

Thus, according to some embodiments the at least two audio objects are associated with at least one audio-object dependency metadata for allowing augmentation control according to the dependencies between the immersive audio components. This dependency metadata in some embodiments provided to the 6DoF audio renderer, which can then, for example, place the at least two audio objects in the 6DoF content under the conditions allowed by the dependency metadata. This maintains the 3DoF audio content quality as high as possible while still allowing for a large amount of freedom in audio placement for the 6DoF scene for most practical 3DoF augmentation audio signals.

In some embodiments the dependency metadata can include at least one of the following control information:

- largest distance allowed between at least two audio objects;
- largest distance allowed between at least two audio objects relative to distance to user;
- rotation relative to user; and
- a rotation of an audio object constellation.

The dependency metadata can furthermore in some embodiments include very specific rules, such as:

- user permission to get between at least two audio objects
- audio object constellation configuration (e.g., object A must always be left, object B in middle, object C right), which may relate to control information 'rotation relative to user' and/or 'rotation of an audio object constellation'

In some embodiments, the audio-only dependencies can be indicated to the user via a visual user interface (UI). One example of such UI is a visual 'rubber-band' effect between the visualizations of the related audio objects.

With respect to FIG. 1 an example apparatus and system for implementing embodiments of the application are shown. The system 171 is shown with a content production 'analysis' part 121 and a content consumption 'synthesis' part 131. The 'analysis' part 121 is the part from receiving a suitable input (multichannel loudspeaker, microphone array, ambisonics) audio signals 100 up to an encoding of the metadata and transport signal 102 which may be transmitted or stored 104. The 'synthesis' part 131 may be the part from a decoding of the encoded metadata and transport signal 104, the augmentation of the audio signal and the presentation of the generated signal (for example in a suitable binaural form 106 via headphones 107 which furthermore are equipped with suitable headtracking sensors which may signal the content consumer user position and/or orientation to the synthesis part).

The input to the system 171 and the 'analysis' part 121 in some embodiments is therefore audio signals 100. These may be suitable input multichannel loudspeaker audio signals, microphone array audio signals, or ambisonic audio signals. In some embodiments the 'analysis' part 121 is simply the means or otherwise for obtaining of a suitable data stream comprising transport audio signals, and metadata.

The input audio signals 100 may be passed to a converter 101. The converter 101 may be configured to receive the input audio signals and generate a suitable data stream 102 for transmission or storage 104. The data stream 102 may comprise suitable transport signals which may be further encoded.

The data stream 102 may further comprise metadata associated with the input audio signals (and thus associated with the transport signals). The metadata can consist, e.g., of spatial audio parameters which aim to characterize the sound-field of the input audio signals. The metadata in some embodiments is also encoded with the transport audio signals. The converter 101 can, for example, be a computer (running suitable software stored on memory and on at least one processor), or alternatively a specific device utilizing, for example, FPGAs or ASICs.

Furthermore in some embodiments the data stream 102 comprises at least one control input which may be encoded as additional metadata.

At the synthesis side 131, the received or retrieved data (stream) may be input to a synthesis processor 105. The synthesis processor 105 may be configured to demultiplex the data (stream) to (coded) transport and metadata. The synthesis processor 105 may then decode any encoded streams in order to obtain the transport signals and the metadata.

The synthesis processor 105 may then be configured to receive the transport signals and the metadata and create a suitable multi-channel audio signal output 106 (which may be any suitable output format such as binaural, multi-channel loudspeaker or Ambisonics signals, depending on the use case) based on the transport signals and the metadata. In some embodiments with loudspeaker reproduction, an actual physical sound field is reproduced (using the loudspeakers 107) having the desired perceptual properties. In other embodiments, the reproduction of a sound field may be understood to refer to reproducing perceptual properties of a sound field by other means than reproducing an actual physical sound field in a space. For example, the desired perceptual properties of a sound field can be reproduced over headphones using the binaural reproduction methods as described herein. In another example, the perceptual properties of a sound field could be reproduced as an Ambisonic output signal, and these Ambisonic signals can be reproduced with Ambisonic decoding methods to provide for example a binaural output with the desired perceptual properties.

In some embodiments the output device, for example the headphones, may be equipped with suitable headtracker or more generally user position and/or orientation sensors configured to provide position and/or orientation information to the synthesis processor 105.

Furthermore in some embodiments the synthesis side is configured to receive an audio (augmentation) source 110 audio signal 112 for augmenting the generated multi-channel audio signal output. The synthesis processor 105 in such embodiments is configured to receive the augmentation source 110 audio signal 112 and is configured to augment the output signal in a manner controlled by the control metadata as described in further detail herein.

The synthesis processor 105 can in some embodiments be a computer (running suitable software stored on memory and on at least one processor), or alternatively a specific device utilizing, for example, FPGAs or ASICs.

Figure 2:
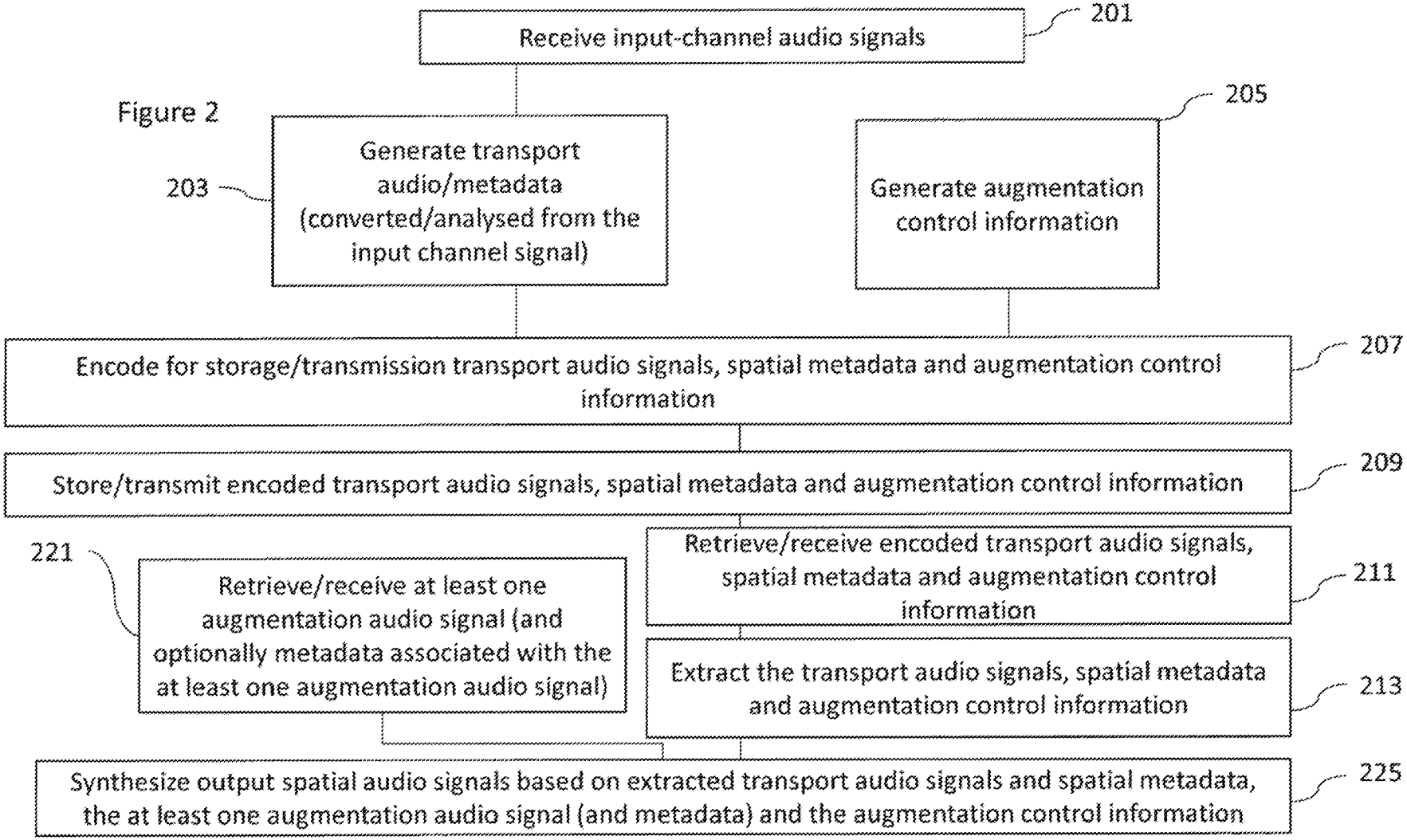
FIG. 2 shows a flow diagram of the operation of the system as shown in FIG. 1 according to some embodiments.

With respect to FIG. 2 an example flow diagram of the overview shown in FIG. 1 is shown.

First the system (analysis part) is configured to optionally receive input audio signals or suitable multichannel input as shown in FIG. 2 by step 201.

Then the system (analysis part) is configured to generate a transport signal channels or transport signals (for example downmix/selection/beamforming based on the multichannel input audio signals) and spatial metadata related to the 6DoF scene as shown in FIG. 2 by step 203.

Also the system (analysis part) is optionally configured to generate augmentation control information as shown in FIG. 2 by step 205. In some embodiments, this can be based on a control signal by an authoring user.

The system is then configured to (optionally) encode for storage/transmission the transport signals, the spatial metadata and control information as shown in FIG. 2 by step 207.

After this the system may store/transmit the transport signals, spatial metadata and control information as shown in FIG. 2 by step 209.

The system may retrieve/receive the transport signals, spatial metadata and control information as shown in FIG. 2 by step 211.

Then the system is configured to extract the transport signals, spatial metadata and control information as shown in FIG. 2 by step 213.

Furthermore the system may be configured to retrieve/receive at least one augmentation audio signal (and optionally metadata associated with the at least one augmentation audio signal) as shown in FIG. 2 by step 221.

The system (synthesis part) is configured to synthesize an output spatial audio signals (which as discussed earlier may be any suitable output format such as binaural, multichannel loudspeaker or Ambisonics signals, depending on the use case) based on extracted audio signals, spatial metadata, the at least one augmentation audio signal (and metadata) and the augmentation control information as shown in FIG. 2 by step 225.

Figure 3:
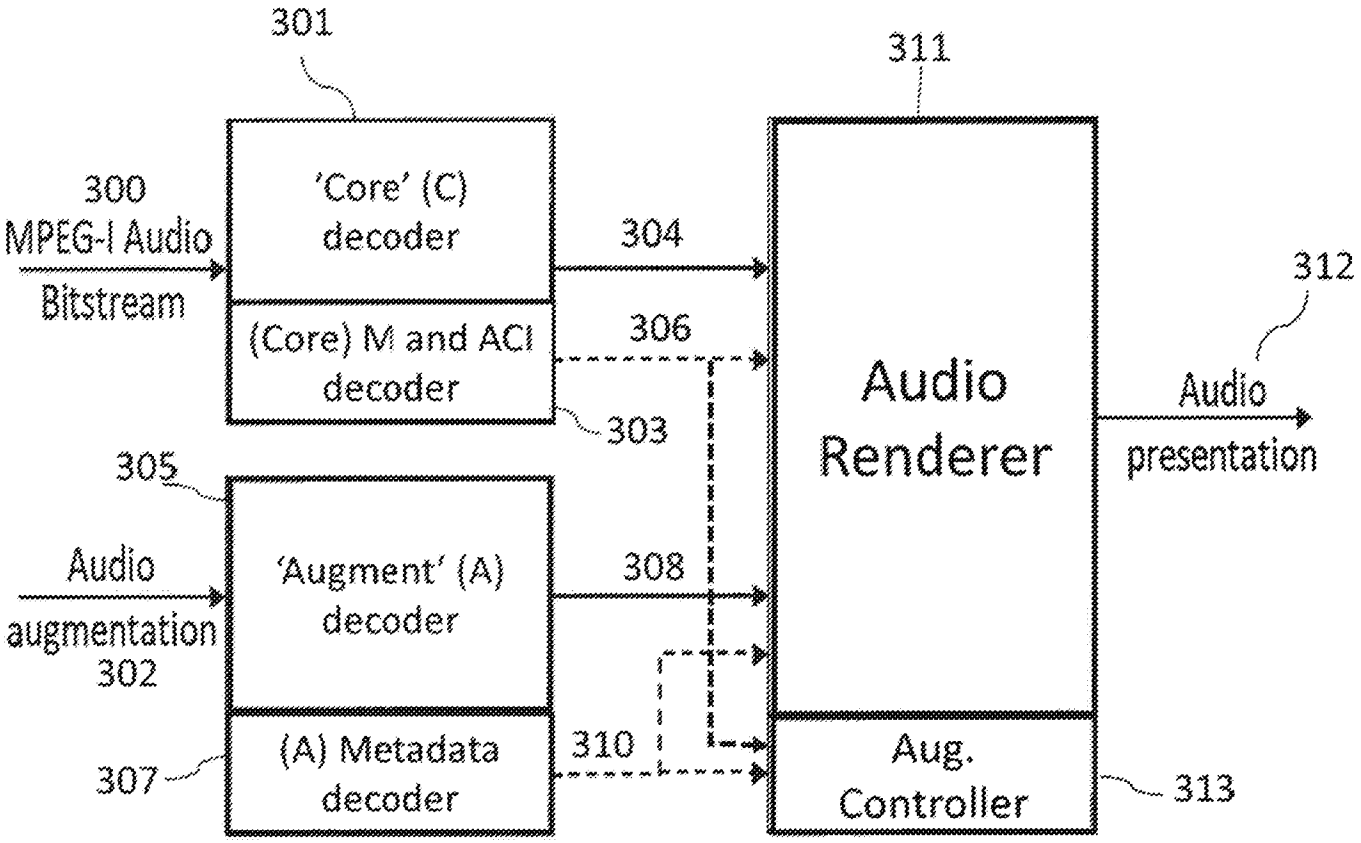
FIG. 3 shows schematically an example synthesis processor apparatus as shown in FIG. 1 suitable for implementing some embodiments.

With respect to FIG. 3 an example synthesis processor is shown according to some embodiments. The synthesis processor in some embodiments comprises a core part which is configured to receive the immersive content stream 300 (shown in FIG. 3 by the MPEG-I audio bit-stream). The immersive content stream 300 may comprise the transport audio signals, spatial metadata and augmentation control information (which may in some embodiments be considered to be a further metadata type). The synthesis processor may comprise a core part, an augmentation part and a controlled renderer part.

The core part may comprise a core decoder 301 configured to receive the immersive content stream 400 and output a suitable audio stream 304, for example a decoded transport audio stream, suitable to transmit to an audio renderer 311.

Furthermore the core part may comprise a core metadata and augmentation control information (M and ACI) decoder 303 configured to receive the immersive content stream 300 and output a suitable spatial metadata and augmentation control information stream 306 to be transmitted to the audio renderer 311 and the augmentation controller (Aug. Controller) 313.

The augmentation part may comprise an augment (A) decoder 305. The augment decoder 305 may be configured to receive the audio augmentation stream comprising audio signals to be augmented into the rendering, and output decoded audio signals 308 to the audio renderer 311. The augmentation part may further comprise a metadata decoder configured to decode from the audio augmentation input metadata such as spatial metadata 310 indicating a desired or preferred position for spatial positioning of the augmentation audio signals (or alternatively and in addition, a non-allowed spatial positioning or augmentation signal type), the spatial metadata associated with the augmentation audio may be passed to the augmentation controller 313 and to the audio renderer 311.

The controlled renderer part may comprise an augmentation controller 313. The augmentation controller may be configured to receive the augmentation control information and control the audio rendering based on this information. For example in some embodiments the augmentation control information defines the controlled areas and levels or tiers of control (and their behaviours) associated with augmentation in these areas.

The controlled renderer part may furthermore comprise an audio renderer 311 configured to receive the decoded immersive audio signals and the spatial metadata from the core part, the augmentation audio signals and the augmentation metadata from the augmentation part and generate a controlled rendering based on the audio inputs and the output of the augmentation controller 313. In some embodiments the audio renderer 311 comprises any suitable baseline 6DoF decoder/renderer (for example a MPEG-I 6DoF renderer) configured to render the 6DoF audio content according to the user position and rotation. In some embodiments, the audio content being augmented may be a 3DoF/3DoF+ content and the audio renderer 311 comprises a suitable 3DoF/3DoF+ content decoder/renderer. In parallel it may receive indications or signals from the augmentation controller based on the 'position' of the content consumer user and any controlled areas. This may be used, at least in part, to determine whether audio augmentation is allowed to begin. For example, an incoming call could be blocked or the 6DoF content rendering paused (according to user settings), if the current content allows no augmentation and augmentation is pushed. Alternatively and in addition, the augmentation control is utilized when an incoming stream is available and the system determines how to render it.

Figure 4:
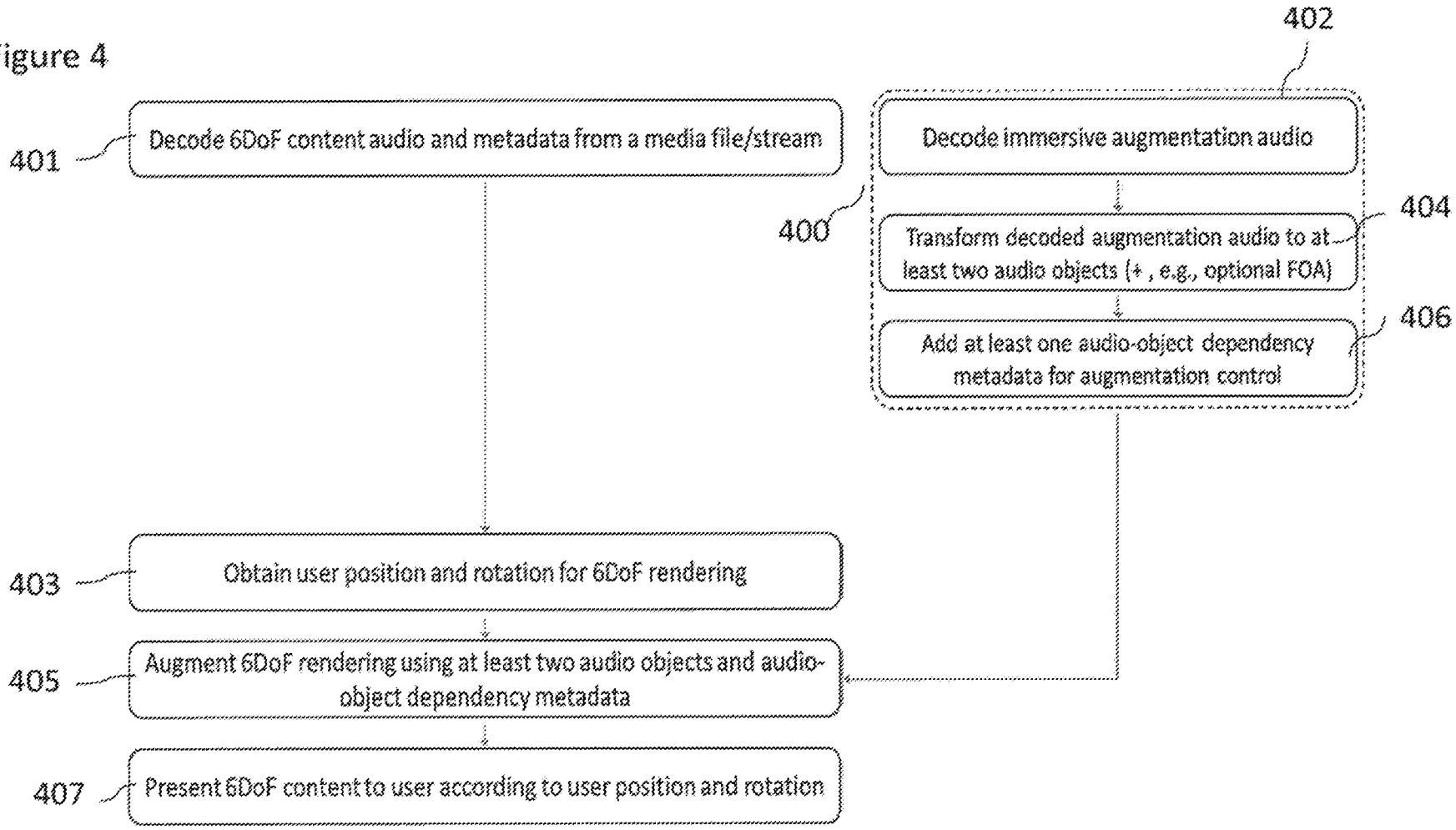
FIG. 4 shows a flow diagram of the operation of the synthesis processor apparatus as shown in FIG. 3 according to some embodiments.

With respect to FIG. 4 is shown an example flow diagram of the rendering operation with controlled augmentation according to some embodiments. In these embodiments the immersive augmentation audio is decoded in parallel to the 6DoF content. The audio representation or the decoded output of the immersive augmentation audio stream for example may not be suitable for the 6DoF renderer (e.g., it may not be supported by a standard or technology used for the 6DoF renderer). Thus, the audio is directly decoded, or alternatively transformed after the decoding, into a compatible presentation. For example in some embodiments a compatible representation can comprise at least of two audio objects (and optionally an ambience signal for example a first order ambience signal). In some embodiments in order to maintain the dependencies part of the optimal sound scene representation in the object-based presentation of the 3DoF augmentation audio, at least one audio-object dependency metadata is created and added for controlling the augmentation rendering.

The immersive content (spatial or 6DoF content) audio and associated metadata may be decoded from a received/retrieved media file/stream as shown in FIG. 4 by step 401.

In some embodiments the augmentation audio (and associated spatial metadata) may be obtained as shown in FIG. 4 by step 400.

The obtaining of the augmentation audio (and associated spatial metadata) as shown in FIG. 4 by step 400 may in some embodiments be divided into the following operations.

The immersive content, augmentation audio is decoded as shown in FIG. 4 by step 402.

The decoded augmentation audio is then transformed into at least two audio objects (and furthermore in some embodiments an additional ambience signal) as shown in FIG. 4 by step 404.

Additionally at least one audio object dependency is added as metadata for augmentation control purposes as shown in FIG. 4 by step 406.

The user position and rotation control may be configured to furthermore obtain a content consumer user position and rotation for the 6DoF rendering operation as shown in FIG. 4 by step 403.

Having generated the base 6DoF render the render is augmented based on the at least two audio objects and audio-object dependency metadata as shown in FIG. 4 by step 405.

The augmented rendering may then be presented to the content consumer user based on the content consumer user position and rotation as shown in FIG. 4 by step 407.

Figure 5:
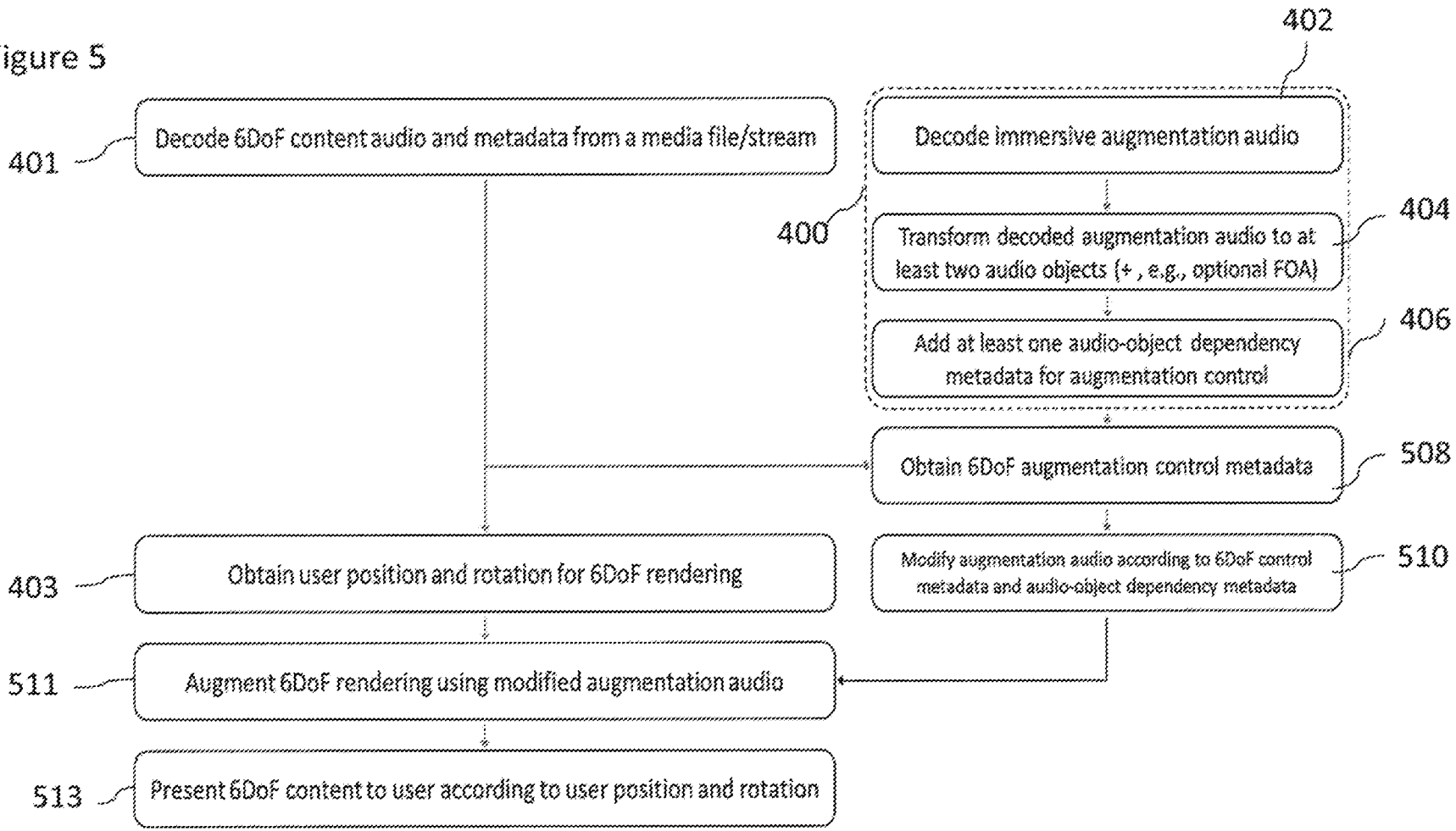
FIG. 5 shows a flow diagram of the operation of the synthesis processor apparatus as shown in FIG. 3 according to some further embodiments.

With respect to FIG. 5 is shown a further example flow diagram of the rendering operation with controlled augmentation according to some further embodiments. The difference to the method as shown in FIG. 4 is that in this example 6DoF augmentation control metadata (for example provided by MPEG-I 6DoF content metadata) is available. This metadata may have an effect on the augmentation audio signal. The augmentation audio may in some embodiments as shown be modified prior to rendering (e.g., certain types of content streams may be dropped, etc.) based on the 6DoF augmentation control metadata. However, here the modification also considers the audio-object dependency metadata. In other words in some embodiments any modification that breaks a dependency is not allowed.

The immersive content (spatial or 6DoF content) audio and associated metadata may be decoded from a received/retrieved media file/stream as shown in FIG. 5 by step 401.

In some embodiments the augmentation audio (and associated spatial metadata) may be obtained as shown in FIG. 5 by step 400.

The obtaining of the augmentation audio (and associated spatial metadata) as shown in FIG. 5 by step 400 may in some embodiments be divided into the following operations.

The immersive content, augmentation audio is decoded as shown in FIG. 5 by step 402.

The decoded augmentation audio is then transformed into at least two audio objects (and furthermore in some embodiments an additional ambience signal) as shown in FIG. 5 by step 404.

Additionally at least one audio object dependency is added as metadata for augmentation control purposes as shown in FIG. 5 by step 406.

Having obtained the at least two audio objects (and furthermore in some embodiments an additional ambience signal) and the audio object dependency as part of the obtaining of the augmentation audio and metadata operations, the (6DoF) augmentation control information (metadata) may be obtained (for example from the immersive content file/stream) as shown in FIG. 5 by step 508.

In some embodiments the obtained at least two audio objects (and furthermore in some embodiments an additional ambience signal) based on the audio object dependency and the obtained augmentation control information as shown in FIG. 5 by step 510.

The user position and rotation control may be configured to furthermore obtain a content consumer user position and rotation for the 6DoF rendering operation as shown in FIG. 5 by step 403.

Having generated the base 6DoF render the render is augmented based on the at least two audio objects and audio-object dependency metadata (further modified based on the obtained augmentation control information and audio object dependency as shown in FIG. 5 by step 511.

The augmented rendering may then be presented to the content consumer user based on the content consumer user position and rotation as shown in FIG. 5 by step 513.

As shown in the methods above an arbitrary 3DoF audio stream (e.g., a parametric representation from a 3GPP IVAS codec) can be transformed into another representation based on the separation of any 'directional' components of the audio field or sounds into audio objects and non-directional components of the audio field into a suitable 'ambient' signals such as a FOA or a channel-based audio signal.

Figure 6:
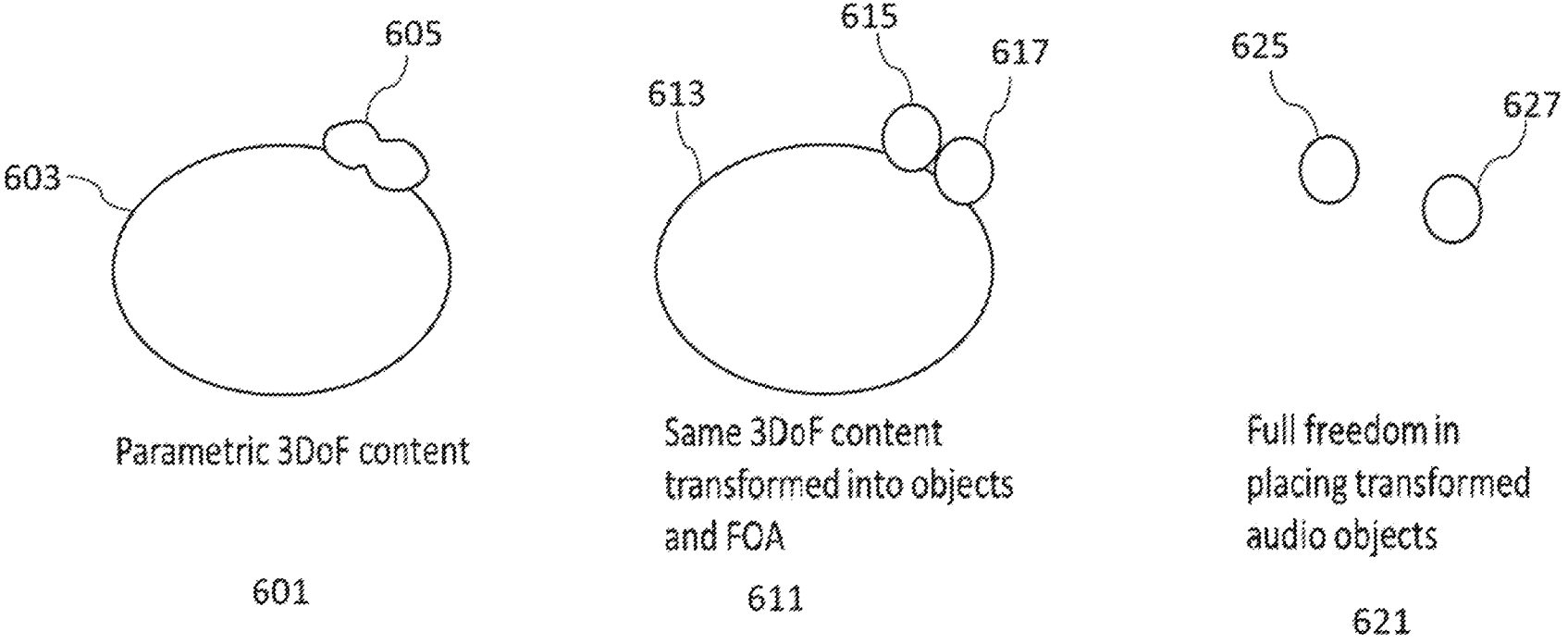
FIG. 6 shows schematically examples of the effect of a 'perfect transformation' from a parametric representation into an alternative representation to some embodiments.

This is illustrated in FIG. 6. For example FIG. 6 shows on the left hand side 601 an example parametric 3DoF content comprising an audio field with a directional component 605 and a non-directional component 603.

FIG. 6 also shows a transformed object and FOA version 611 of the same 3DoF content. The FOA 613 is a perceptual transformation of the non-directional components 603 of the original audio field and the objects 615 and 617 are perceptual transformation of the directional component 605 of the original audio field. If such transformation is close to perfect, this will generally allow, e.g., full freedom of audio object placement in the 6DoF scene with good perceptual quality. This is shown on the right hand side as the objects 615 and 617 are moved apart and shown as objects 625 and 627 respectively and the FOA 613 is removed.

In a system employing practical signals the separation of objects may be improved upon. For example, two sound sources relatively close to each other, will likely produce some leakage in the spatial analysis (the spatial parameters) and each object generated based on the spatial analysis therefore comprise energy associated with the sound source being transformed and at least part of the audio energy associated with the other sound source. There can be further leakage between the at least two audio objects, when they are being separated from the parametric representation. Thus, if a full freedom of placement is applied, and the user can, e.g., walk between two audio objects, there may be some "phantom" sound of a first audio source in the direction of the second audio object (that is dominantly the second audio source) and some "phantom" sound of a second audio source in the direction of the first audio object (that is dominantly the first audio source). The embodiments as described herein attempt to reduce the confusion to the user and produce a better user experience by the use of the limitation controls as described herein.

In some embodiments, the audio-object dependency metadata can describe a dependency between at least two audio objects that belong to a 6DoF content. For example, a social virtual reality (VR) application may allow a communication and/or augmentation of a user's 6DoF environment and experience from a second, different 6DoF content that is being consumed by a second user. This may be, for example, consumption of two separate 6DoF contents by users A and B (as previously commented) and a communication/augmentation between them.

In such use case, the second user can choose a part of a content the user is experiencing (e.g., relating to at least one audio object) for sending to the first user along the second user's voice input. The audio-object dependency can in this instance describe a dependency between an audio object corresponding to the user's voice and at least one audio object that is part of the scene. Alternatively, the dependency can be between at least two audio objects belonging to said scene. For example, the dependency could be such that if user B wishes to send an audio object (for example an audio object J) to user A, then a further audio object (for example audio object K) is spatially tagged with the audio object J (in other words defining a spatial dependency between the audio object and the further audio object). Such dependency information is needed due to the first user's content being a different content. Thus, the first user's rendering application, e.g., does not otherwise have necessary information to maintain a consistent user experience relating to the augmented objects and their rendering in the first user's 6DoF environment.

It is understood that when two users simultaneously consume the same 6DoF content, however, the service or application may not need the additional signaling related to an audio-object dependency. This is because the content (such as audio objects) and the overall environment understanding (such as a scene graph or other scene description) are by default the same for the two users participating in the social VR experience.

Figure 7:
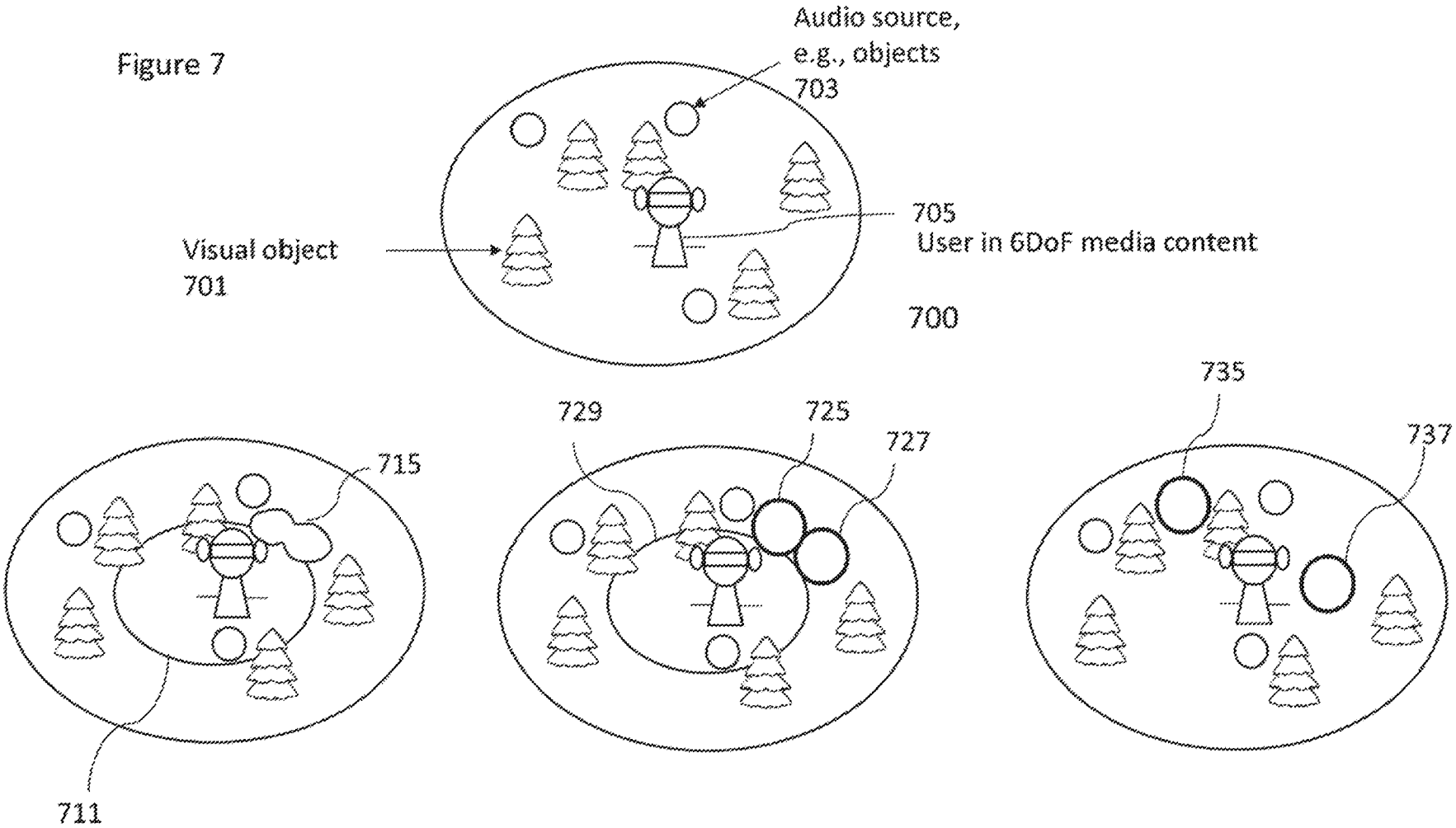
FIG. 7 shows schematically examples of 3DoF object augmentation to 6DoF media content on an example augmentation scenario according to some embodiments.

FIG. 7 shows illustrations of a user experiencing a 6DoF media content and various types of 3DoF augmentation (such as shown in FIG. 6) rendered together with the 6DoF content. Thus for example FIG. 7 shows the user 705 in a 6DoF media content 700 where the user is located relative to audio sources 703 and sees virtual objects 701 within the environment.

Additionally the user is shown on the bottom left image in 6DoF media content which is augmented by the example parametric 3DoF content represented by directional component 715 and a non-directional component 711.

The user is shown on the bottom middle image in 6DoF media content which is augmented by the transformed object 725, 727 and FOA 729 version of the same 3DoF content.

On the bottom right image the user is shown where the objects 725 and 727 are moved apart and shown as objects 735 and 737 respectively and the FOA part is removed (or not used).

Figure 8A:
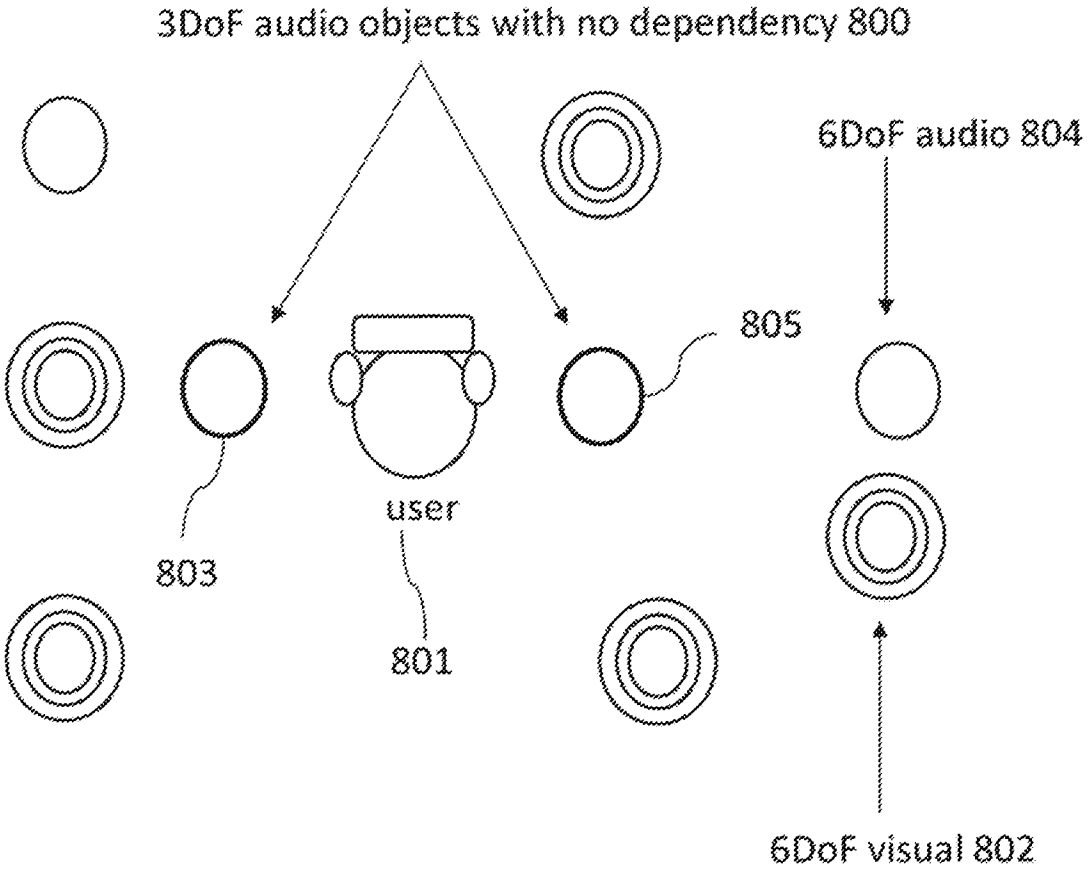
FIGS. 8*a* and 8*b* show schematically examples of 3DoF object augmentation to 6DoF media content on an example augmentation scenario without and with dependency according to some embodiments.
Figure 8B:
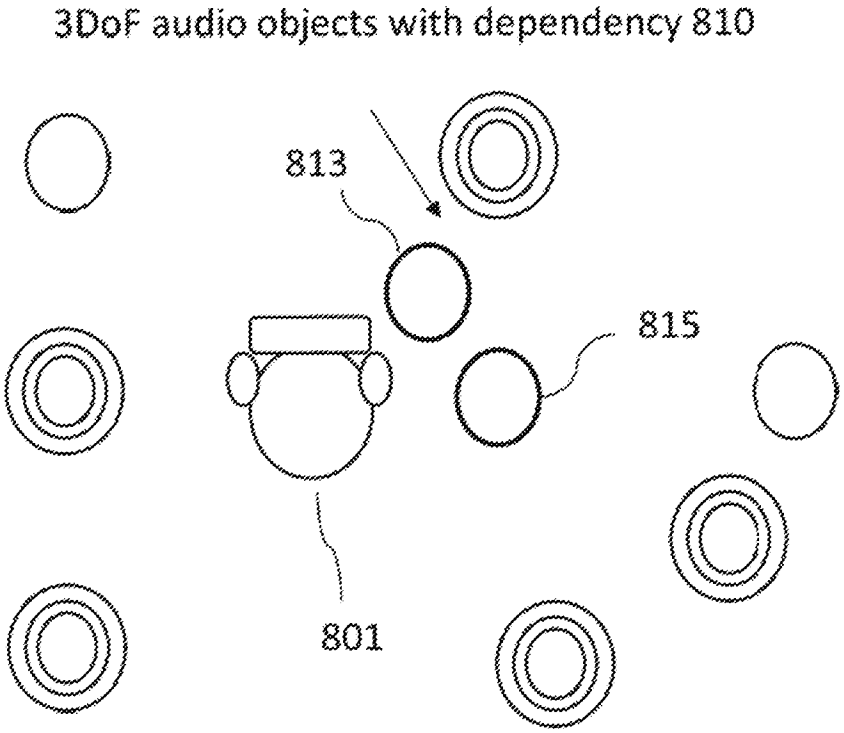

FIGS. 8*a* and 8*b* furthermore show illustrative examples of how two 3DoF augmentation audio objects without dependency (FIG. 8*a*) and with dependency (FIG. 8*b*) may be implemented according to some embodiments when a user is near the augmentation audio objects and when experiencing 6DoF content.

FIG. 8*a* thus shows an environment 800 in which there are augmented 3DoF audio objects augmenting the 6DoF environment but with no dependencies associated with the 3DoF augmentation objects. The 6DoF environment comprises audio objects, for example lighter shaded circles 804 and visual objects, for example darker shaded circles 802 which are located about the user 801. Within this environment the 3DoF audio objects (without dependences) are placed. In some circumstances such as shown in FIG. 8*a* the user may locate themselves between the objects 803 and 805 which may cause the user to experience the effects as discussed above. However if the dependency metadata according to the various embodiments allows the user to go between the objects (i.e., there is no corresponding restriction signalled for the audio objects), then the perception of being between the objects is allowed.

FIG. 8*b* further shows an environment 810 in which there are augmented 3DoF audio objects augmenting the 6DoF environment but with dependencies associated with the 3DoF augmentation audio objects. The 6DoF environment comprises audio objects and visual objects in the same manner as in FIG. 8*a* but within this environment the 3DoF audio objects (with dependences) are placed. The dependency may for example be one which prevents the user from being located between the audio objects 813 and 815, and for example relocates or places one or other of the audio objects 813 such that the user can not locate themselves between the objects even when trying to do so.

In some cases the 3DoF augmentation may be "permanent" or "fixed" in nature in the sense that it does not consider the user position (other than for the direction and distance rendering). For example, a user may be able to walk through the augmented audio such that the position to which the 3DoF audio is placed in the 6DoF content is not changed based on the user movement. In other cases, the augmented audio may react in at least some ways to the user movement or support other interactions.

Figures 9A, 9B, 9C:
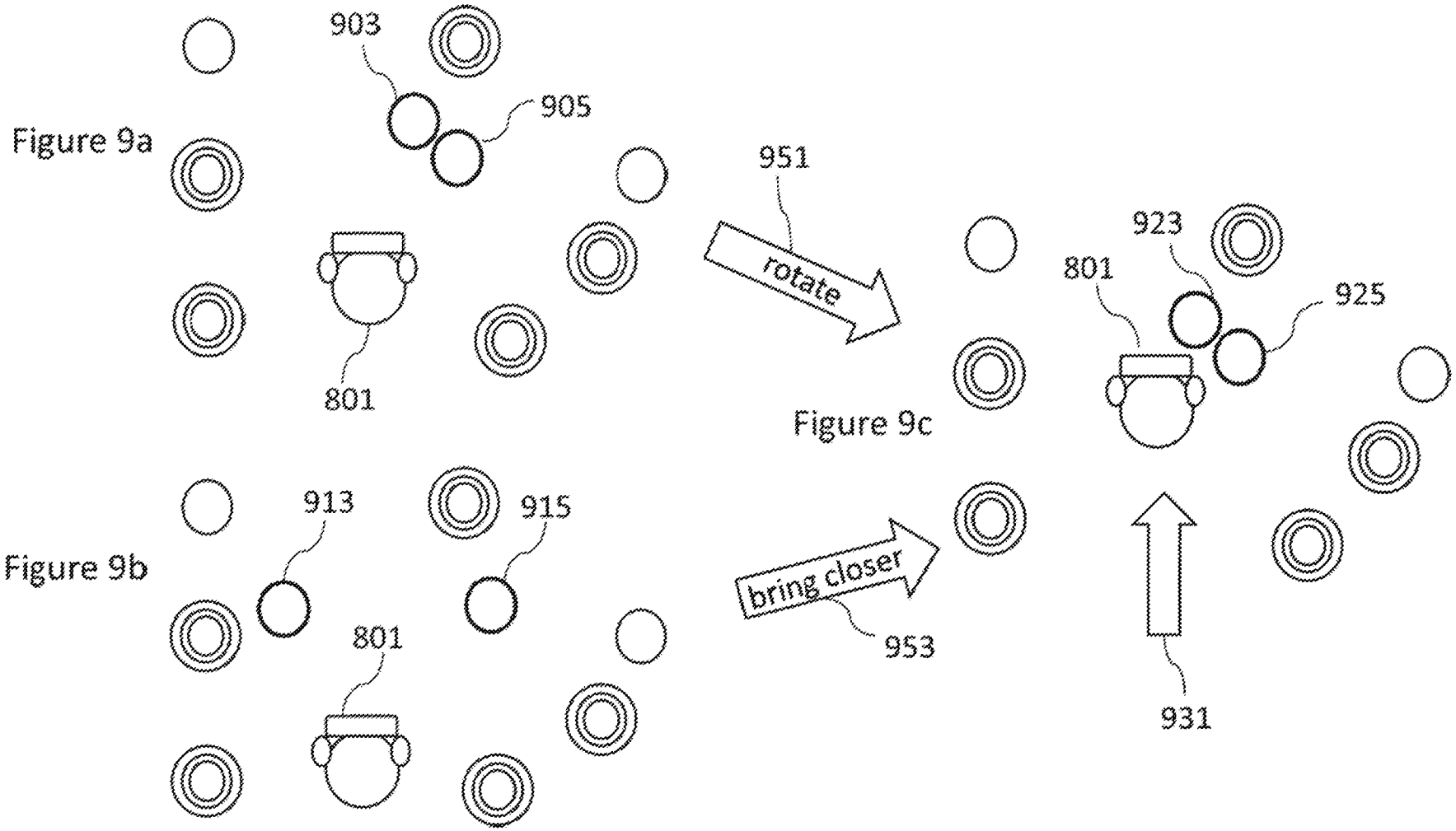
FIGS. 9*a* to 9*c* show schematically examples of the effect of augmentation control on 6DoF media content in an example augmentation scenario according to some embodiments.

FIGS. 9*a*, 9*b* and 9*c* illustrate how a user approaching a 3DoF augmentation audio (which comprises two audio objects with at least one dependency parameter metadata) may be rendered based on at least a user distance to a reference position.

FIG. 9*a* and FIG. 9*c* reflect the start and end of a rotation 951. FIG. 9*a* which shows the 6DoF visual (dark circle) and audio (light circle) objects and a user 801 located at a first position. The 3DoF audio objects 903 and 905 may furthermore be associated with a dependency parameter or criteria (metadata) which may 'force' the 3DoF audio objects to be close to each other.

As shown by the end of the rotation 951, FIG. 9*c* shows where the audio object pair 923 and 925 rotate according to a user position such that the audio objects face the user similarly as in the original 3DoF audio content.

FIG. 9*b* and FIG. 9*c* reflect the start and end of a relative distance modification 953, where the at least two audio objects 913 and 915 may be allowed to be rendered at a relative distance to each other when the user is, e.g., beyond a certain threshold distance. When the user however approaches 931 at least one of the at least two audio objects (with the dependency information), the distance between the at least two audio objects is reduced.

In some embodiments, the spatial location modification of the audio objects of the 3DoF augmentation audio in the 6DoF media content rendering based on the user distance may be achieved using any suitable method. Thus, at least one aspect relating to the dependency metadata may be inserted as an audio interaction metadata for at least one of the at least two audio objects. This may include an effective distance or a similar distance based parameter definition.

In some embodiments, the audio-object dependency information may be part of the 3DoF content bit-stream (or a separate metadata stream). Thus, the dependency information transmitted alongside or as part of the 3DoF content may be decoded during step 'Decode immersive augmentation audio' in FIGS. 4*a* and 4*b*, and a separate analysis may not thus be required during the 3DoF content format transformation processing.

In some embodiments, a UI may allow for a placement control of the audio objects into a 6DoF scene by the end user. The UI may indicate a dependency between at least two audio objects to make the user aware of how a placement control of at least a first audio object may affect the placement and/or orientation of at least a second audio object or, alternatively and in addition, how a placement control of at least a first audio object separately may be prohibited and at least two audio objects need to be controlled together or as one unit.

One example of such UI, is a visual rubber-band effect between the visualizations of the audio objects. This is shown in FIGS. 10*a*, 10*b*, 10*c*, and 10*d*.

Figure 10A:
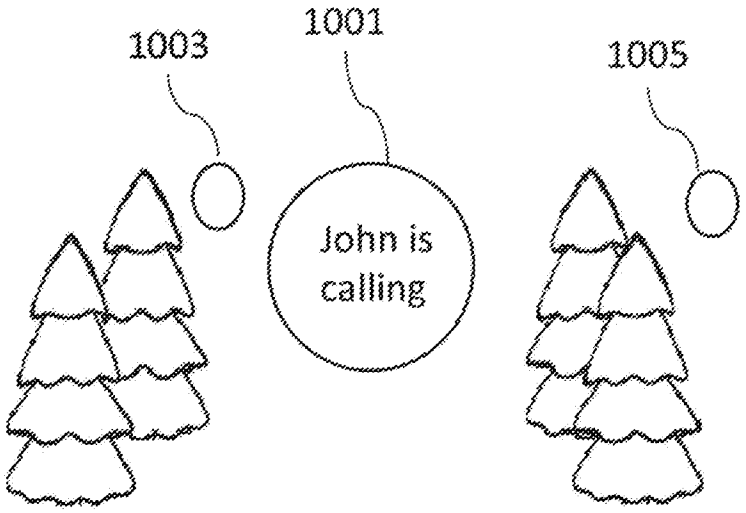
FIGS. 10*a* to 10*d* show schematically examples of user interface and use case examples for augmentation control on 6DoF media content in an example augmentation scenario according to some embodiments.

FIG. 10*a* for example shows a user interface for a first user who is consuming a 6DoF media content (such as MPEG-I VR content) and the visual objects (shown as trees) and the audio objects 1003 and 1005. In this example the user receives an augmentation request 1001 due to a second user (John) calling a 3GPP IVAS call to first user.

Figure 10B:
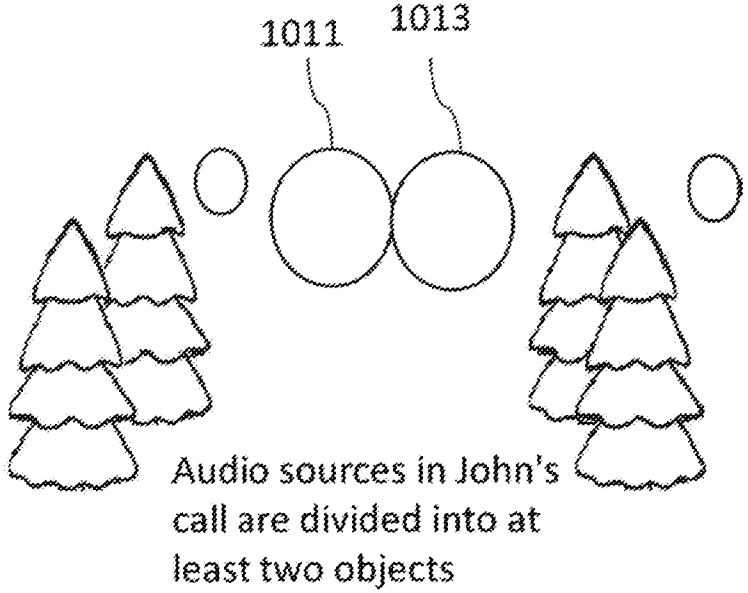
Figure 10D:
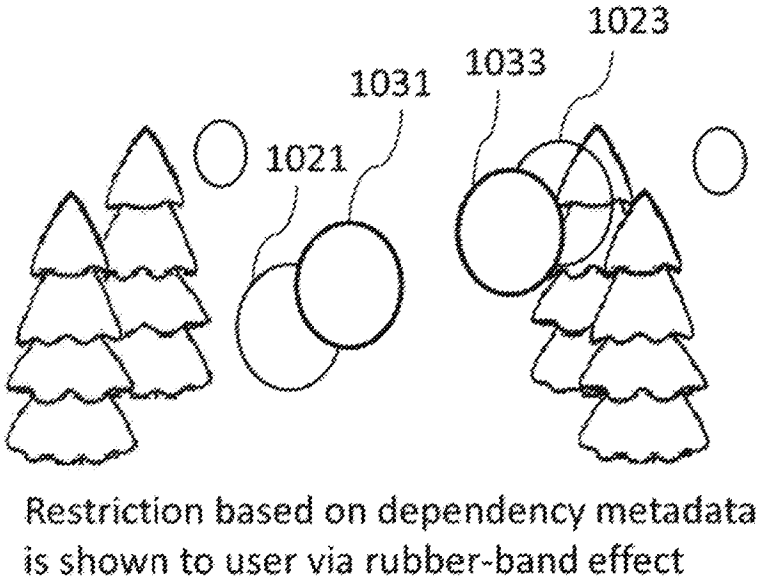

FIG. 10*b* shows the effect of accepting the call (for example interacting with the augmentation request 1001) where the 3DoF audio objects 1011 and 1013 transformed from John's IVAS MASA parametric sound-scene audio stream are placed into the 6DoF rendering.

Figure 10C:
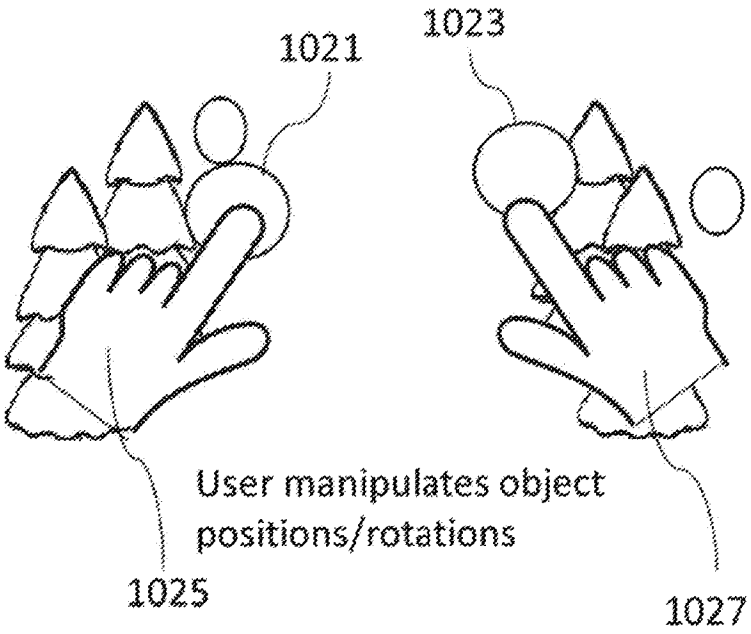

FIG. 10*c* shows a further interaction with the user interface where the user is not happy with the placement and wishes to widen the stereo image by interacting 1025, 1027 with the objects 1011 and 1013 to place them further apart and at locations 1021 and 1023.

However in this example the audio format transforming process detected that there is a sound-scene dependency between the two audio objects. It inserted a dependency control parameter or criteria (as metadata) associated with the audio objects. Based on the dependency control parameter, the 6DoF renderer of the first user detects a restriction to the user's attempt to place the objects as locations 1021 and 1023 and 'bounces' or otherwise locates the visual representations of the audio objects 1031 and 1033 to the widest possible setting that is allowed for the two audio objects. This widest possible setting may in some embodiments be based on the relative distance to the first user. In such a manner the audio presentation remains at a high perceptual quality level.

Figure 11:
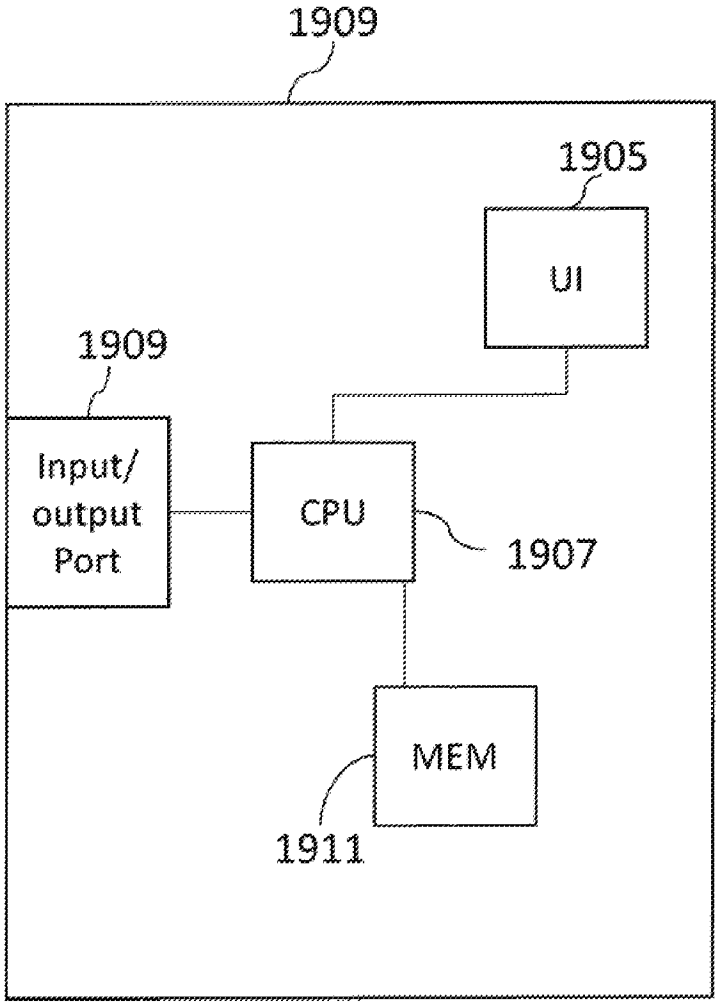
FIG. 11 shows schematically shows schematically an example device suitable for implementing the apparatus shown.

With respect to FIG. 11 an example electronic device which may be used as the analysis or synthesis device is shown. The device may be any suitable electronics device or apparatus. For example in some embodiments the device 1400 is a mobile device, user equipment, tablet computer, computer, audio playback apparatus, etc.

In some embodiments the device 1900 comprises at least one processor or central processing unit 1907. The processor 1907 can be configured to execute various program codes such as the methods such as described herein.

In some embodiments the device 1900 comprises a memory 1911. In some embodiments the at least one processor 1907 is coupled to the memory 1911. The memory 1911 can be any suitable storage means. In some embodiments the memory 1911 comprises a program code section for storing program codes implementable upon the processor 1907. Furthermore in some embodiments the memory 1911 can further comprise a stored data section for storing data, for example data that has been processed or to be processed in accordance with the embodiments as described herein. The implemented program code stored within the program code section and the data stored within the stored data section can be retrieved by the processor 1907 whenever needed via the memory-processor coupling.

In some embodiments the device 1900 comprises a user interface 1905. The user interface 1905 can be coupled in some embodiments to the processor 1907. In some embodiments the processor 1907 can control the operation of the user interface 1905 and receive inputs from the user interface 1905. In some embodiments the user interface 1905 can enable a user to input commands to the device 1900, for example via a keypad. In some embodiments the user interface 1905 can enable the user to obtain information from the device 1900. For example the user interface 1905 may comprise a display configured to display information from the device 1900 to the user. The user interface 1905 can in some embodiments comprise a touch screen or touch interface capable of both enabling information to be entered to the device 1900 and further displaying information to the user of the device 1900.

In some embodiments the device 1900 comprises an input/output port 1909. The input/output port 1909 in some embodiments comprises a transceiver. The transceiver in such embodiments can be coupled to the processor 1907 and configured to enable a communication with other apparatus or electronic devices, for example via a wireless communications network. The transceiver or any suitable transceiver or transmitter and/or receiver means can in some embodiments be configured to communicate with other electronic devices or apparatus via a wire or wired coupling.

The transceiver can communicate with further apparatus by any suitable known communications protocol. For example in some embodiments the transceiver or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

The transceiver input/output port 1909 may be configured to receive the loudspeaker signals and in some embodiments determine the parameters as described herein by using the processor 1907 executing suitable code. Furthermore the device may generate a suitable transport signal and parameter output to be transmitted to the synthesis device.

In some embodiments the device 1900 may be employed as at least part of the synthesis device. As such the input/output port 1909 may be configured to receive the transport signals and in some embodiments the parameters determined at the capture device or processing device as described herein, and generate a suitable audio signal format output by using the processor 1907 executing suitable code. The input/output port 1909 may be coupled to any suitable audio output for example to a multichannel speaker system and/or headphones or similar.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. An apparatus comprising at least one processor and at least one non-transitory memory including a computer program code, the at least one memory and the computer program code configured to, with the at least one processor, cause the apparatus at least to:

obtain at least one spatial audio signal comprising at least one audio signal, wherein the at least one spatial audio signal defines an audio scene forming at least in part media content;

render the audio scene based on the at least one spatial audio signal;

obtain at least one augmentation audio signal;

transform the at least one augmentation audio signal to at least two audio objects; and augment the audio scene based on the at least two audio objects.

2. The apparatus as claimed in claim 1, wherein the apparatus is configured to use the transformed at least two audio objects to at least one of:

generate at least one control criteria associated with the at least two audio objects; or augment the audio scene based on the at least one control criteria associated with the at least two audio objects.

3. The apparatus as claimed in claim 2, wherein the apparatus is configured to use the augment of the audio scene based on the at least one control criteria to at least one of:

define a largest distance allowed between the at least two audio objects;

define a largest distance allowed between at least two audio objects relative to a distance to a user;

define a rotation relative to a user;

define a rotation of an audio object constellation;

define whether a user is permitted to be located between the at least two audio objects; or define an audio object constellation configuration.

4. The apparatus as claimed in claim 1, where the apparatus is further configured to obtain at least one augmentation control parameter associated with the at least one audio signal, wherein the augmented audio scene is based on the at least two audio objects and the at least one augmentation control parameter.

5. The apparatus as claimed in claim 1, wherein the apparatus is configured to obtain the at least one spatial audio signal, and wherein the at least one audio signal is decoded from a first bit stream using the at least one spatial audio signal and at least one spatial parameter.

6. The apparatus as claimed in claim 5, wherein the first bit stream is a MPEG-I audio bit stream.

7. The apparatus as claimed in claim 5, where the apparatus is further configured to obtain at least one augmentation control parameter, wherein the apparatus is configured to decode from the first bit stream the at least one augmentation control parameter associated with the at least one audio signal.

8. The apparatus as claimed in claim 1, wherein the apparatus is further configured to decode from a second bit stream the at least one augmentation audio signal, wherein the second bit stream is a low-delay path bit stream.

9. The apparatus as claimed in claim 1, wherein, with the obtained at least one augmentation audio signal the apparatus is configured to obtain at least one of:

at least one user voice audio signal;

at least one ambience part captured at a user position; or at least two audio objects selected from a set of audio objects to augment the at least one spatial audio signal.

10. A method comprising:

obtaining at least one spatial audio signal comprising at least one audio signal, wherein the at least one spatial audio signal defines an audio scene forming at least in part media content;

rendering the audio scene based on the at least one spatial audio signal;

obtaining at least one augmentation audio signal;

transforming the at least one augmentation audio signal to at least two audio objects; and augmenting the audio scene based on the at least two audio objects.

11. The method as claimed in claim 10, wherein transforming the at least one augmentation audio signal to at least two audio objects comprises at least one of:

generating at least one control criteria associated with the at least two audio objects; or augmenting the audio scene based on the at least one control criteria associated with the at least two audio objects.

12. The method as claimed in claim 11, wherein augmenting the audio scene based on the at least one control criteria comprises at least one of:

defining a largest distance allowed between the at least two audio objects;

defining a largest distance allowed between at least two audio objects relative to a distance to a user;

defining a rotation relative to a user;

defining a rotation of an audio object constellation;

defining whether a user is permitted to be located between the at least two audio objects; or defining an audio object constellation configuration.

13. The method as claimed in claim 10, further comprising obtaining at least one augmentation control parameter associated with the at least one audio signal, wherein augmenting the audio scene further comprises augmenting the audio scene based on the at least two audio objects and the at least one augmentation control parameter.

14. The method as claimed in claim 10, further comprising obtaining at least one spatial audio signal, wherein the at least one audio signal is decoded from a first bit stream using the at least one spatial audio signal and at least one spatial parameter.

15. The method as claimed in claim 14, wherein the first bit stream is a MPEG-I audio bit stream.

16. The method as claimed in claim 14, wherein obtaining the at least one augmentation control parameter further comprises decoding from the first bit stream the at least one augmentation control parameter associated with the at least one audio signal.

17. The method as claimed in claim 10, wherein obtaining the at least one augmentation audio signal further comprises decoding from a second bit stream the at least one augmentation audio signal.

18. The method as claimed in claim 17, wherein the second bit stream is a low-delay path bit stream.

19. The method as claimed in claim 10, wherein obtaining the at least one augmentation audio signal comprises obtaining at least one of:

at least one user voice audio signal;

at least one ambience part captured at a user position; or at least two audio objects selected from a set of audio objects to augment the at least one spatial audio signal.

20. A non-transitory program storage device readable by a machine, tangibly embodying a program of instructions executable by the machine for performing operations, the operations comprising the method as claimed in claim 10.

* * * * *